US006164826A

United States Patent [19]

Petkovsek

[11] Patent Number: 6,164,826

[45] Date of Patent: Dec. 26, 2000

[54] RESEALABLE SPOUT FOR SIDE-GUSSETED PACKAGES

[75] Inventor: Gregory L. Petkovsek, Appleton, Wis.

[73] Assignee: Reynolds Consumer Products Inc., Appleton, Wis.

[21] Appl. No.: 09/169,292

[22] Filed: Oct. 9, 1998

[51] Int. Cl.[7] ..... B65D 30/20; B65D 33/22; B65D 33/24

[52] U.S. Cl. ..... 383/210; 383/61; 383/63; 383/66; 383/120; 383/906

[58] Field of Search ..... 383/63, 65, 906, 383/120, 66, 61, 210, 211

[56] References Cited

U.S. PATENT DOCUMENTS

| | | | |
|---|---|---|---|
| 2,098,258 | 11/1937 | Rowe . | |
| 2,147,117 | 2/1939 | Bensel | 383/906 |
| 2,188,039 | 1/1940 | Farmer | 383/906 |
| 2,696,342 | 12/1954 | Toborg | 383/906 |
| 2,929,123 | 3/1960 | Schneideman . | |
| 3,137,419 | 6/1964 | Davy | 383/906 |
| 3,361,333 | 1/1968 | Stuart . | |
| 4,071,187 | 1/1978 | LaFleur . | |
| 4,191,230 | 3/1980 | Ausnit | 383/61 |
| 4,332,344 | 6/1982 | Strodthoff . | |
| 4,617,683 | 10/1986 | Christoff . | |
| 4,620,665 | 11/1986 | McSherry . | |
| 4,657,792 | 4/1987 | Ausnit | 383/63 |
| 4,758,099 | 7/1988 | Branson . | |
| 4,953,708 | 9/1990 | Beer et al. . | |
| 4,997,289 | 3/1991 | Sasaki et al. . | |
| 5,104,235 | 4/1992 | Bronstrup et al. | 383/66 |
| 5,240,112 | 8/1993 | Newburger | 383/41 |
| 5,364,189 | 11/1994 | Kuge et al. . | |
| 5,392,589 | 2/1995 | Buchanan | 383/906 |
| 5,480,230 | 1/1996 | May | 383/9 |
| 5,547,284 | 8/1996 | Imer | 383/906 |
| 5,716,473 | 2/1998 | Gordon et al. | 383/120 |
| 5,882,117 | 3/1999 | Laffon | 383/6 |

*Primary Examiner*—Stephen P. Garbe
*Attorney, Agent, or Firm*—Merchant & Gould P.C.

[57] ABSTRACT

A package includes a surrounding wall enclosing a containment region and a spout. The spout is movable relative to the surrounding wall between a retracted position and a protracted position. A first resealable closure mechanism is secured to the spout for selectively opening and closing communication between the mouth of the spout and the containment region. In another embodiment, a second resealable closure mechanism is secured around an outer periphery of the spout mouth, when the spout is in the protracted position. When the spout is moved into the retracted position, the second resealable closure mechanism is along the interior of the mouth and allows the mouth to be selectively opened and closed. In another embodiment, a peelable seal is secured to the spout arrangement for providing a hermetic seal. Methods for constructing and using a package having a pour spout are described.

17 Claims, 3 Drawing Sheets

RESEALABLE SPOUT FOR SIDE-GUSSETED PACKAGES

FIELD OF THE INVENTION

The present invention generally relates to closure arrangements for polymer packages, such as side-gusseted packages. In particular, the present invention relates to resealable closure mechanisms or zipper-type closures for resealable packages.

1. Background

Many packaging applications use side-gusseted packages to store various types of articles and materials. These packages may be used to store and ship food products, non-food consumer goods, medical supplies, waste materials, and many other articles. Side-gusseted packages can be used with a pour spout to help the user easily dispense the package contents.

In some pourable side-gusseted packages, the pourable spout does not seal completely. This can lead to product degradation or contamination when the product is exposed to the outside elements. Furthermore, the product may spill out of the package if the package is tilted or dropped. Improvements are desirable.

2. Summary of the Invention

In one aspect of the present invention, there is a package comprising a surrounding wall enclosing a containment region, a spout arrangement, and a first resealable closure mechanism secured to the spout arrangement. The spout arrangement defines a mouth in flowable communication with the containment region. The spout arrangement is movable relative to the surrounding wall between a retracted position arrangement is movable relative to the surrounding wall between a retracted position and a protracted position. The retracted position includes the spout arrangement being completely contained within the containment region by the surrounding wall. The protracted position includes the spout arrangement projected outwardly from the containment region. The first resealable closure mechanism is selectively interlockable to selectively open and close communication between the spout arrangement mouth and the containment region.

In one embodiment, the first resealable closure mechanism is secured within the mouth of the spout arrangement.

In another embodiment, the first resealable closure mechanism is secured between the containment region and the spout arrangement mouth.

In another embodiment, a peelable seal is provided in the spout arrangement for providing a hermetic seal.

In another aspect, the invention is directed to a package comprising a package wall and a pour spout. The package wall is arranged to form side-gussets and a bottom section. The pour spout includes first and second opposed panel sections having a plurality of edges. The first panel section has first and second edges, where the first edge is coterminous with one of the side-gussets. The second panel section has third and fourth edges, where the third edge is coterminous with the one side-gusset. The second and fourth edges meet to form an outside edge. The first and second panel section define a mouth providing access to a region between the first and second panel sections, where the mouth defines a center line therethrough. The spout has a protracted position and a retracted position. The outside edge is constructed and arranged to travel along the mouth centerline to move the spout from the protracted position to the retracted position and to move the spout from the retracted position to the protracted position. The protracted position includes the pour spout projecting away from the one side-gusset. The retracted position includes the spout resting within the package interior. A first resealable closure mechanism is secured to the pour spout.

In another aspect, a method for using a package having an interior and pour spout with a mouth in communication with the interior is described. The method includes a step of pulling the pour spout from within the interior of the package into a protracted position outside of the package interior. The method also includes a step of applying a force along the resealable closure mechanism to close communication between the pour spout mouth and the package interior.

The above summary of principles of the present invention is not intended to describe each illustrated embodiment or every implementation of the present invention. The figures and the detailed description that follow more particularly exemplify these embodiments.

BRIEF DESCRIPTION OF THE DRAWINGS

Principles of the invention may be more completely understood in consideration of the detailed description of various embodiments of the invention that follows in connection with the accompanying drawings in which.

Figure 1:
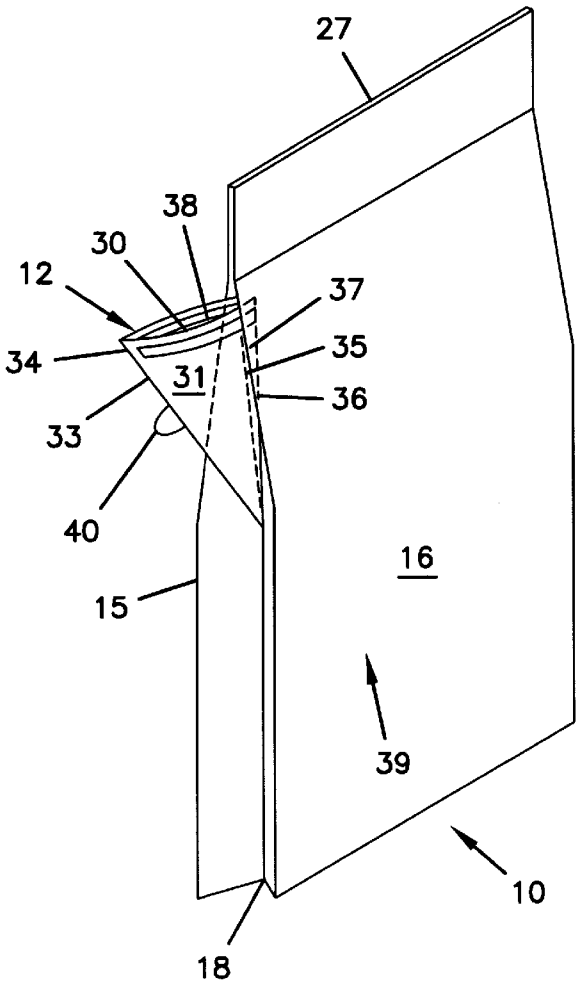
FIG. 1 is a perspective view of a side-gusseted package with a resealable, pourable spout in a protracted orientation, according to an example embodiment of the present invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

The present invention is believed to be applicable to a variety of packaging arrangements. An appreciation of various aspects of the invention is best gained through a discussion of an application example for such a packaging arrangement.

According to an example embodiment of the present invention, a side-gusseted package has a resealable, pourable spout. FIG. 1 illustrates an example package 10 that benefits from the use of such resealable, pourable spouts.

FIG. 1 illustrates an example packaging arrangement in the form of a side-gusseted package 10 having a pour spout 12 constructed in accordance with principles of the present invention. The package 10 includes a surrounding wall, for example, in the form of first and second opposed panel sections 15, 16. Generally, the first and second panel sections 15, 16 are multilayered structures comprising a polymer material or a combination of paper and a polymer material. The example package 10 has a rectangular bottom section (not shown) and side-gussets 18 (one not shown). The side-gussets 18 and the bottom section enable the package 10 to stand upright. The side-gusseted package 10 is constructed in a conventional manner Typically, the package 10 is filled with a product through a mouth at the top 27 of the package 10. After the package 10 is filled with a product, the top 27 of the package 10 is sealed in a conventional manner. Consumer access to the contents of the package 10 is provided through the pourable spout 12 in the side-gusset 18 of the package 10.

The pourable spout 12 generally has first and second opposed panel sections 30, 31. The first and second panel sections 30, 31 of the pourable spout 12 meet at an outside edge 33 at a first end 34 of the panel sections 30, 31. The panel sections 30, 31 are integral or coterminous with the side-gusset 18 at their respective opposite, inside edges 35, 36. The inside edges 35, 36 define a gap 37 for the contents of the package 10 to pass through. The first and second panel sections 30, 31 also define a mouth 38 of the pourable spout 12. When the package 10 is tilted, such that the pourable spout 12 is lower than the contents of the package 10, the contents of the package 10 flow from a package containment region or interior 39 through the gap 37 between the inside edges 35, 36, along the outside edge 33 of the pourable spout 12, and out of the package 10 through the mouth 38 of the pourable spout 12. That is, the mouth 38 is in flowable communication with the package interior 39. In FIG. 1, the pourable spout 12 is shown protracted, or extending outwardly from remaining portions of the package 10.

Figure 2:
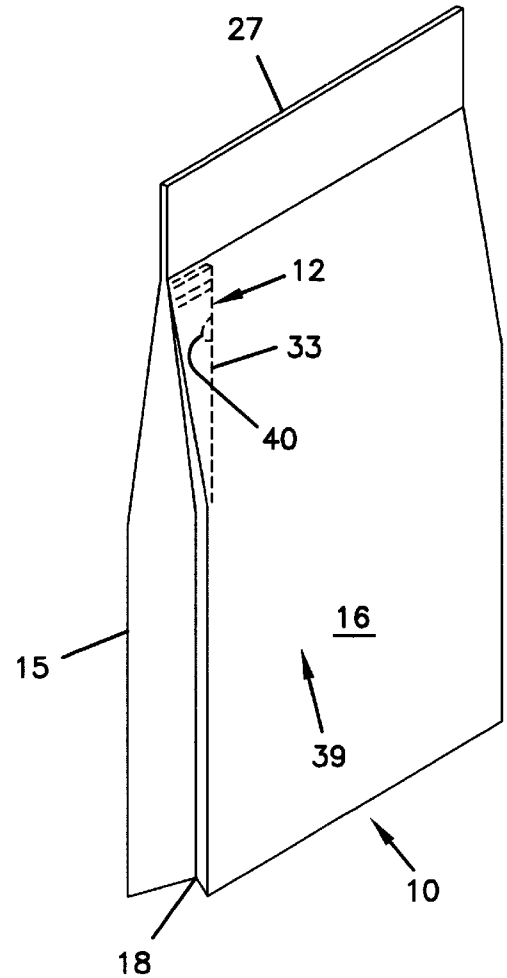
FIG. 2 is a perspective view of the side-gusseted package of FIG. 1 with the resealable, pourable spout retracted, according to an example embodiment of the present invention.

Attention is directed to FIG. 2. The first and second panel sections 30, 31 (FIG. 1) are flexible such that the pourable spout 12 can be selectively pushed or retracted into the package 10 as shown in FIG. 2. By "pushed into the package," it is meant that pressure can be applied to the pourable spout 12 at the outside edge 33 causing the outside edge 33 to travel inward toward the package 10, along the centerline of the mouth 38, and continue into the package interior 39. As the outside edge 33 moves into the package interior 39, the first and second panel sections 30, 31 bend outward away from each other. When the panel sections 30, 31 bend, a spring-like force is created in the panel sections 30, 31 as the panel sections 30, 31 try to straighten out to their normal, semi-flat position. After the outside edge 33 passes the side-gusset 18 of the package 10 and the force applied to the outside edge 33 is released, the first and second panel sections 30, 31 straighten out, snapping the pourable spout 12 into the interior 39 of the package 10. By "snapping," it is meant that the flexed first and second panel sections 30, 31 provide sufficient force to propel the pourable spout 12 into the package interior 39. In its retracted position, the pourable spout 12 is contained entirely within the package 10 as defined by the panel sections 15, 16, the bottom, the top 27, and the side gussets 18. In this manner, the pourable spout 12 operates analogously to a paper milk carton spout. While the pourable spout 12 is retracted into the package 10, it is difficult to pour the contents out through the mouth 38 of the pourable spout 12.

To pour the contents out of the package 10, the consumer must open the pourable spout 12. A tab 40 extends from the outside edge 33. Preferably, the consumer grasps the tab 40 and pulls it outward, applying a force to the outside edge 33 propelling it outward away from the interior 39 of the package 10. Again, the first and second panel sections 30, 31 bend as the outside edge 33 moves outward creating a spring-like force in the panel sections 30, 31. After the fold line 33 passes the side-gusset 18, the panel sections 30, 31 will snap the pourable spout 12 outward, allowing the consumer to pour the contents out of the package 10.

Figure 3B:
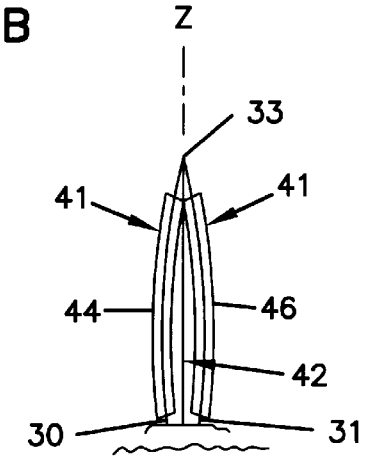
FIG. 3B is a fragmented, schematic, top plan view of the resealable, pourable spout of the side-gusseted package of FIG. 2, according to an example embodiment of the present invention.
Figure 3A:
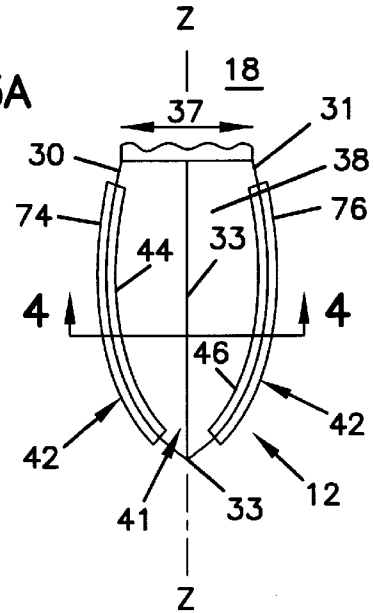
FIG. 3A is a fragmented, schematic, top plan view of the resealable, pourable spout of the side-gusseted package of FIG. 1, also according to an example embodiment of the present invention.

Attention is directed to FIG. 3A. FIG. 3A is a top plan view of the pourable spout 12 in its protracted position as depicted in FIG. 1. In this particular embodiment, the pourable spout 12 has a first resealable closure mechanism 41 for selectively opening and closing communication between the mouth 38 and the package interior 39. In the embodiment illustrated, the closure mechanism 41 is attached to the interior of the mouth 38 of the pourable spout 12. The pourable spout 12 also has a second resealable closure mechanism 42 attached to the exterior of the mouth 38 of the pourable spout 12.

Attention is directed to FIG. 3B. FIG. 3B is a top plan view of the pourable spout 12 in its retracted and closed position as depicted in FIG. 2. As can be seen in FIG. 3B, the first resealable closure mechanism 41 is on the exterior of the mouth 38, when the pourable spout 12 is in its retracted, closed position. The second resealable closure mechanism 42 is along the interior of the mouth 38 of the pourable spout 12, when in the retracted, closed position. By comparing FIGS. 3A and 3B, it can be appreciated that when the pourable spout 12 is moved from its open, pourable position into its closed, retracted position, the relative positions of the first and second closure mechanisms 41, 42 reverse. The first closure mechanism 41 moves from interior to exterior, while the second resealable closure mechanism 42 moves from exterior to interior.

Figure 4:
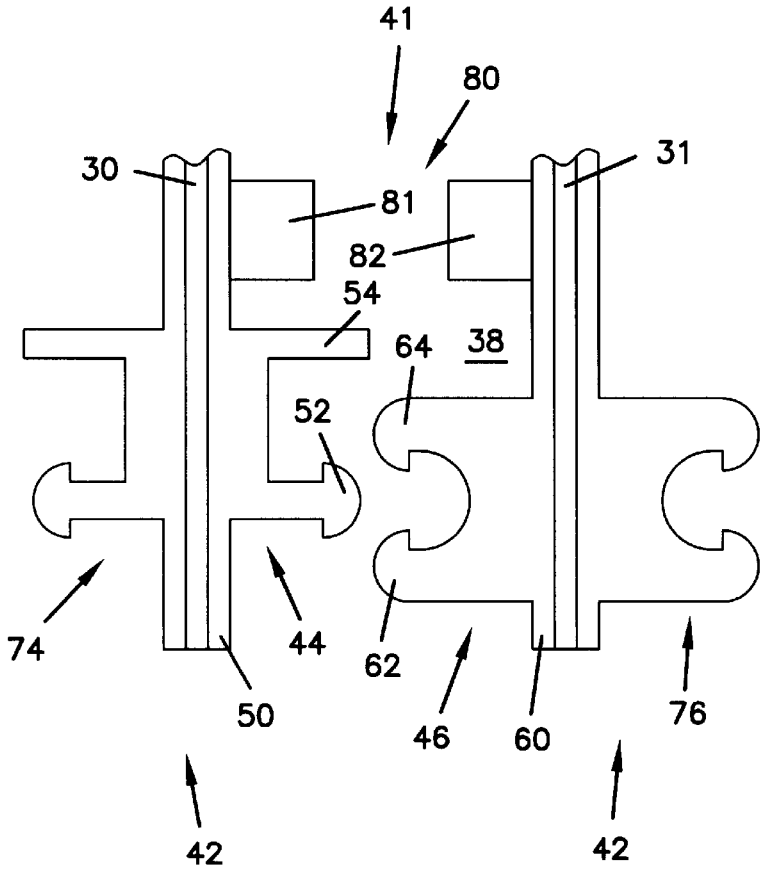
FIG. 4 is a fragmented, cross-sectional, schematic view taken along the line 4—4 of FIG. 3A of the resealable closure mechanism, according to an example embodiment of the present invention.

Attention is directed to FIG. 4. FIG. 4 is an enlarged, cross-sectional view of the mouth 38 of the resealable, pourable spout 12 taken along the line 4—4 of FIG. 3A. The first and second resealable closure mechanisms 41, 42 are shown in an unlocked, open condition. The first and second closure mechanisms 41, 42 can be one of a variety of closure mechanisms. In the particular embodiment illustrated in FIG. 4, the resealable closure mechanisms 41, 42 are shown in the specific form of a zipper-type closure mechanism. By the term "zipper-type closure mechanism," it is meant a structure having opposite interlocking or mating profiled elements that under the application of pressure will interlock and close the region between the profiles. In particular, the zipper-type closure mechanisms of FIG. 4 are an illustration of one example of a single-track closure mechanism. By "single-track," it is meant that each profile has one pair of hooks or members for interlocking or engaging.

The first resealable closure mechanism 41 includes an elongated first or male closure profile 44 and an elongated second or female closure profile 46. Typically, the first and second closure profiles 44, 46 are manufactured separately from each other. The first closure profile 44 includes a base strip 50 and an interlocking closure member 52. The interlocking closure member 52 extends from the base strip 50 and is generally projecting from the base strip 50. The first closure profile 44 also includes a guide post 54. The guide post 54 also extends from the base strip 50 and is generally projecting from the base strip 50. The guide post 54 aids in holding the closure mechanism closed and in aligning the first closure profile 44 with the second closure profile 46 for interlocking. Preferably, the base strip 50 is attached to a first panel section, such as the first panel section 30 of the pourable spout 12.

The second closure profile 46 includes a base strip 60 and first and second interlocking closure members 62, 64. The interlocking closure members 62, 64 extend form the base strip 60 and are generally projecting from the base strip 60. The first and second interlocking closure members 62, 64 are designed to receive the interlocking closure member 52 of the first closure profile 44. Preferably, the base strip 60 is attached to a second panel section, such as the second panel section 31 of the pourable spout 12.

The first and second closure profiles 44, 46 are designed to engage with one another to form a resealable closure mechanism 41. The interlocking closure member 52 of the first closure profile 44 extends from the base strip 50 a certain distance. The interlocking closure members 62, 64 of the second closure profile 46 also extend from the base strip 60 a certain distance. These certain distances, that the closure members 52, 62, 64 extend, are sufficient to allow mechanical engagement, or interlocking, between the interlocking closure member 52 of the first closure profile 44 and the interlocking closure members 62, 64 of the second closure profile 46. The guide post 54 aids in aligning the closure profiles 44, 46 and in keeping the closure profiles 44, 46 interlocked. Furthermore, the closure profiles 44, 46 are sealed together at the outside edge 33 of the pourable spout 12 to further aid in aligning the closure profiles 44, 46 for interlocking. Pressure is applied to the closure profiles 44, 46 as they engage to form the openable sealed closure mechanism 41. Pulling the first closure profile 44 and the second closure profile 46 away from each other causes the two closure profiles 44, 46 to disengage, opening the mouth 38 of the pourable spout 12. This provides access to the contents of the package 10 through the mouth 38 of the pourable spout 12.

In some applications, the closure profiles 44, 46 are formed by two separate extrusions or through two separate openings of the common extrusion. Typically, the resealable closure mechanism 41 is made of a polymer, plastic material, such as polyethylene or polypropylene. In one example embodiment, the closure arrangement illustrated in FIG. 4 is manufactured using conventional extrusion and heat sealing techniques.

Still in reference to FIG. 4, the second resealable closure mechanism 42 is illustrated on opposite sides of the panel sections 30, 31 as the first resealable closure mechanism 41. The second resealable closure mechanism 42 includes a first closure profile 74 structured analogously as first closure profile 44. The second resealable closure mechanism 42 likewise includes a second closure profile 76 structured analogously as second closure profile 46. In the preferred embodiment shown, the first closure profile 74 is secured to panel section 30 on an opposite side from the first closure profile 44, while the second closure profile 76 is secured to the second panel section 31 on an opposite side from the second closure profile 46.

In certain, preferred applications, the pourable spout 12 will include a system for providing a tamper-evident closure. By the term "tamper-evident", it is meant that a closure provides an indication or evidence to a consumer that the closure was previously opened at least once after initial sealing. While a variety of embodiments are contemplated, in the particular embodiment illustrated, a peelable seal arrangement is used. Still referring to FIG. 4, one type of peelable seal is illustrated general at 80. The peelable seal 80 includes a first peelabe layer 81 and a second peelable layer 82. Typically, the first peelable layer 81 is extruded from a first material while the first closure profile 44 is extruded from a second material. The first material is selected because it bonds well with the second material but has a lower bond strength than the second material. Likewise, the second peelable layer 82 is extruded from the first material while the second closure profile 46 is extruded from the second material. For example, the first and second closure profiles 44, 46 are extruded from polyethylene while the peelable layers 81, 82 are extruded from a polyethylene blend.

During manufacture, the first peelable layer 81 is heat fused with the second peelable layer 82 resulting in one unitary peelable seal 80. Typically, the bond strength of the peelable seal 80 is between two and six pounds per linear inch. This strength provides an adequate hermetic or airtight seal while still allowing the consumer to "peel" the peelable seal 80 apart. By the term "peel," it is meant that upon initial opening of the mouth 38 of the pourable spout 12, the consumer pulls the first and second panel sections 30, 31 away from each other, causing the peelable seal 80 to break apart. Once the peelable seal 80 is broken, it cannot be resealed by the consumer. Instead, the consumer uses the first and second resealable closure mechanisms 41, 42 to seal the mouth 38 of the pourable spout 12. Alternatively, the peelable seal 80 could be located at another location within the pourable spout 12. For example, the peelable seal 80 could be located at the other end of the first resealable closure mechanism 41.

Figure 5:
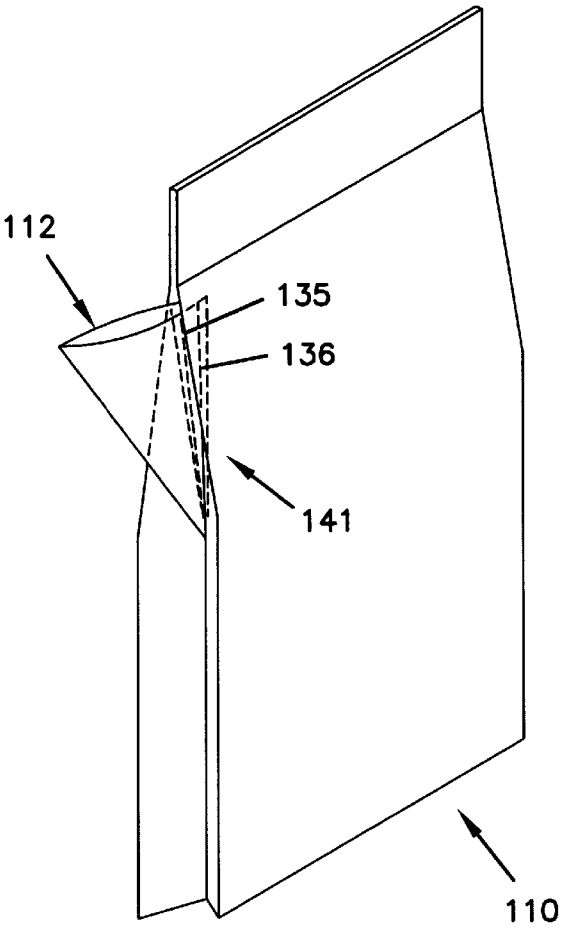
FIG. 5 is a perspective view of a side-gusseted package with a resealable, pourable spout, according to a second example embodiment of the present invention.
Figure 6:
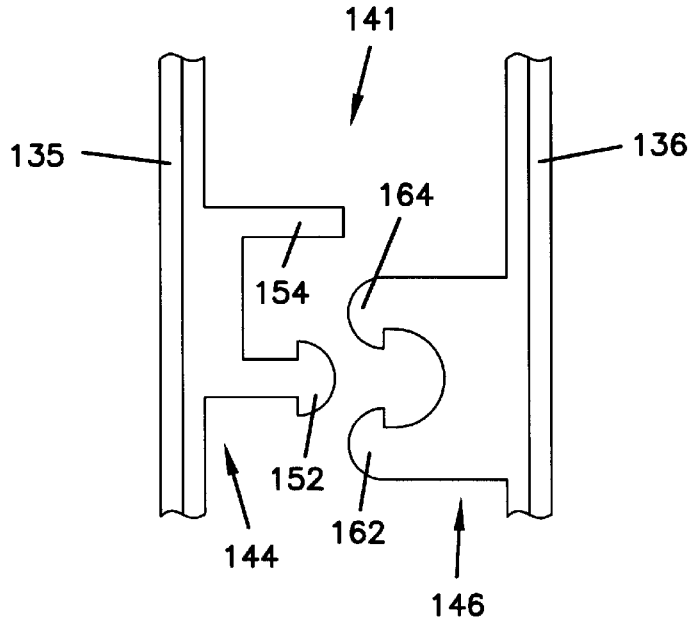
FIG. 6 is a fragmented, cross-sectional, schematic view of a resealable closure mechanism, according to the second example embodiment of the present invention.

Alternatively, the resealable closure mechanism could be placed at other locations within the pourable spout 12. For example, attention is directed to FIG. 5. In another example embodiment, a resealable closure mechanism 141 is provided on the inside edges 135, 136 of the pourable spout 112 (FIG. 5). Attention is directed to FIG. 6. FIG. 6 is an enlarged, cross-sectional view of the resealable closure mechanism 141. The resealable closure mechanism 141 is shown disposed between the inside edges 135, 136 of the pourable spout 112. The resealable closure mechanism 141 has structure analogous to the first resealable closure mechanism 41 of FIG. 4.

Generally, to seal the pourable spout 12 of the package 10 when in its protracted and unlocked or open position as illustrated in FIGS. 3A and 4, the consumer applies pressure to the first and second panel sections 30, 31 of the pourable spout 12 near the mouth 38 of the pourable spout 12, pushing the panel sections 30, 31 together. The pressure causes the first and second closure profiles 44, 46 of the first resealable closure mechanism 41 to interlock, sealing the pourable spout 12. To open the resealable closure mechanism 41, the consumer grasps the first and second panel sections 30, 31 and pulls them away from each other, causing the first and second closure profiles 44, 46 to disengage.

Generally, to seal the resealable spout 12 of the package 10 (FIG. 2) in its retracted position, the user first moves the spout 12 from its protracted position (FIGS. 1 and 3A) to its retracted position (FIGS. 2 and 3B). To do this step, and in reference to FIG. 3A, the user pushes the pourable spout 12 into the package 10 by applying a force to the outside edge 33. The outside edge 33 travels along the centerline Z of the mouth 38 of the pourable spout 12. As the outside edge 33 passes the side-gusset 18 of the package 10, the first and second panel sections 30, 31 of the pourable spout 12 provide sufficient force to propel the pourable spout 12 into the package interior 39 (FIG. 2) and into its retracted position. The panel sections 30, 31 bend to accommodate the outside edge 33 as it travels along the centerline Z. Referring to FIG. 3B, as the outside edge 33 passes the side-gusset 18, the panel sections 30, 31 are turned inside-out and begin to straighten out. This places the first resealable closure mechanism 41 on the outside of the inside-out pourable spout 12. The second resealable closure mechanism 42 is now on the inside of the inside-out pourable spout 12. The propelling force is sufficient to cause the first and second closure profiles 74, 76 (FIG. 4) of the second resealable closure mechanism 42 to interlock, sealing the inside-out pourable spout 12. If enough force is not present to sufficiently lock the zipper, the consumer may run his or her fingers along the top of the package to secure/lock the zipper shut.

To open the resealable closure mechanism 42, the user first moves the spout 12 from its retracted position (FIGS. 2 and 3B) to its protracted position (FIGS. 1 and 3A). To do this step, the user grasps the tab 40 (FIG. 2) of the pourable spout 12 and pulls it out or protracts it. This step also unlocks the closure profiles 74, 76 to move the mouth 38 into the open position.

The above specification and examples are believed to provide a complete description of the manufacture and use of particular embodiments of the invention. Many embodiments of the invention can be made without departing from the spirit and scope of the invention.

What is claimed is:

1. A package comprising:

(a) a surrounding wall enclosing a containment region;

(b) a spout arrangement defining a mouth in flowable communication with the containment region; the spout arrangement being movable relative to the surrounding wall between a retracted position and a protracted position;

(i) the retracted position including the spout arrangement being completely contained within the containment region by the surrounding wall;

(ii) the protracted position including the spout arrangement projecting outwardly from the containment region;

(c) at least a first resealable closure mechanism secured to the spout arrangement;

(i) the first resealable closure mechanism being selectively interlockable to selectively open and close communication between the spout arrangement mouth and the containment region; and (d) a unitary peelable seal secured to the spout arrangement for providing a hermetic seal that the consumer can peel apart.

2. A package according to claim 1 wherein:

(a) the peelable seal is secured within the mouth of the spout arrangement.

3. A package according to claim 1, further comprising:

(a) a tab extending from the spout arrangement constructed and arranged for receiving a pulling force to move the spout arrangement from the retracted position to the protracted position.

4. A package comprising:

(a) a surrounding wall enclosing a containment region;

(b) a spout arrangement defining a mouth in flowable communication with the containment region; the spout arrangement being movable relative to the surrounding wall between a retracted position and a protracted position;

(i) the retracted position including the spout arrangement being completely contained within the containment region by the surrounding wall;

(ii) the protracted position including the spout arrangement projecting outwardly from the containment region;

(c) a first resealable closure mechanism secured to the spout arrangement;

(i) the first resealable closure mechanism being selectively interlockable to selectively open and close communication between the spout arrangement mouth and the containment region; and (d) a second resealable closure mechanism secured to the spout arrangement.

5. A package according to claim 4 wherein:

(a) the second resealable closure mechanism is secured around an outside of the mouth of the spout arrangement, when the spout arrangement is in the protracted position.

6. A package according to claim 5 wherein:

(a) the first resealable closure mechanism is secured within an interior of the mouth of the spout arrangement, when the spout arrangement is in the protracted position.

7. A package according to claim 6 wherein:

(a) the first resealable closure mechanism is oriented around the outside of the mouth of the spout arrangement, when the spout arrangement is in the retracted position; and (b) the second resealable closure mechanism is oriented within the interior of the mouth of the spout arrangement, when the spout arrangement is in the retracted position.

8. A package according to claim 7 wherein:

(a) the spout arrangement comprises a spout having first and second opposed panel sections;

(i) the first panel section having a first and second side edges and opposite, first and second surfaces; the first side edge being coterminous with the surrounding wall;

(ii) the second panel section having third and fourth side edges and opposite, third and fourth surfaces; the third side edge being coterminous with the surrounding wall;

(A) the second and fourth edges meeting to form an outside edge.

9. A package according to claim 8 wherein:

(a) the first resealable closure mechanism includes a first closure profile having a first base strip and at least a first interlocking closure member, and a second closure profile having a second base strip and at least a second interlocking closure member; the first and second closure profiles arranged and configured to selectively interlock when the spout is in the protracted position;

(i) the first base strip being secured to the first surface of the first panel section; and (ii) the second base strip being secured to the third surface of the second panel section.

10. A package according to claim 9 wherein:

(a) the second resealable closure mechanism includes a third closure profile having a third base strip and at least a third interlocking closure member, and a fourth closure profile having a fourth base strip and at least a fourth interlocking closure member; the third and fourth closure profiles arranged and configured to selectively interlock when the spout is in the retracted position;

(i) the third base strip being secured to the second surface of the first panel section; and (ii) the fourth base strip being secured to the fourth surface of the second panel section.

11. A package comprising:

(a) a package wall arranged to form side gussets, a bottom section, and enclosing an interior; and (b) a pour spout; the pour spout including:

(i) first and second opposed panel sections having a plurality of edges;

(A) the first panel section having first and second edges; the first edge being coterminous with one of the side gussets;

(B) the second panel section having third and fourth edges; the third edge being coterminous with the one side gusset; the second and fourth edges meeting to form an outside edge;

(ii) the first and second panel sections defining a mouth providing access to a region between the first and second panel sections; the mouth defining a centerline therethrough;

(iii) the spout having a protracted position and a retracted position; the protracted position including the spout projecting away from the one side-gusset; the retracted position including the spout resting within the package interior;

(A) the outside edge being constructed and arranged to travel along the mouth centerline as the spout is moved from the protracted position to the retracted position and as the spout is moved from the retracted position to the protracted position;

(iv) a first resealable closure mechanism secured to the pour spout; and (v) a second resealable closure mechanism secured to the pour spout.

12. A package according to claim 11 further comprising:

(a) a pulling arrangement extending from the outside edge for moving the pour spout from the retracted position to the protracted position.

13. A package according to claim 11 wherein:

(a) the first resealable closure mechanism includes first and second selectively interlocking profiles; the first profile being secured to the first panel section, and the second profile being secured to the second panel section; and (b) the second resealable closure mechanism includes third and fourth selectively interlocking profiles; the third profile being secured to the first panel section on a side opposite of the first profile; and the fourth profile being secured to the second panel section on a side opposite of the second profile.

14. A method for using a package, the package comprising a package wall, defining an interior region, and a pour spout defining a mouth providing access to the interior region and having a resealable closure mechanism; the pour spout having an outside edge; the mouth having a centerline; the method comprising:

(a) pulling the outside edge of the pour spout to travel along the centerline of the mouth as the pour spout is moved from within the interior of the package into a protracted position outside of the interior region; and (b) applying a force along the resealable closure mechanism to close communication between the pour spout mouth and the interior region.

15. A method according to claim 14, wherein the resealable closure mechanism includes: a first closure profile having a first interlocking closure member, and a second closure profile having a second interlocking closure member; and wherein:

(a) said step of applying a force includes engaging the first closure profile having the first interlocking closure member with the second closure profile having the second interlocking closure member to close communication between the pour spout mouth and the interior region.

16. A method according to claim 14, further comprising:

(a) after said step of applying a force, opening the resealable closure mechanism to open communication between the pout spout mouth and the interior region; and (b) pushing the outside edge of the pour spout to travel along the centerline of the mouth as the pour spout is moved to within the interior region into a retracted position within in the interior region.

17. A method according to claim 16, wherein the package further includes a second resealable closure mechanism; the method further comprising:

(a) applying force along the second resealable closure mechanism to close communication between the pour spout mouth and the interior region while the pour spout is in the retracted position.

* * * * *